US012364279B2

(12) United States Patent
Liu et al.

(10) Patent No.: US 12,364,279 B2
(45) Date of Patent: Jul. 22, 2025

(54) MANUAL HYDRAULIC CIGARETTE MANUFACTURING MACHINE

(71) Applicants: Jiandong Liu, Ruian Zhejiang (CN); Guosheng Song, Zhejiang (CN)

(72) Inventors: Jiandong Liu, Ruian Zhejiang (CN); Guosheng Song, Zhejiang (CN)

( * ) Notice: Subject to any disclaimer, the term of this patent is extended or adjusted under 35 U.S.C. 154(b) by 438 days.

(21) Appl. No.: 17/847,978

(22) Filed: Jun. 23, 2022

(65) Prior Publication Data

US 2022/0408796 A1 Dec. 29, 2022

(30) Foreign Application Priority Data

Jun. 24, 2021 (CN) ..... 202110705646
Jun. 24, 2021 (CN) ..... 202121415561

(51) Int. Cl.
*A24C 5/40* (2006.01)
*A24C 5/42* (2006.01)
*A24C 5/44* (2006.01)

(52) U.S. Cl.
CPC ..... *A24C 5/40* (2013.01); *A24C 5/42* (2013.01); *A24C 5/425* (2013.01); *A24C 5/44* (2013.01)

(58) Field of Classification Search
CPC .. A24C 5/40; A24C 5/42; A24C 5/425; A24C 5/44; B66C 23/54; B66C 23/545
See application file for complete search history.

(56) References Cited

U.S. PATENT DOCUMENTS 3,260,374 A * 7/1966 Haganes ..... B66C 23/54 212/238
3,616,940 A * 11/1971 Milner, Jr. ..... B66C 23/545 212/300
10,857,984 B2 * 12/2020 Righetti ..... B60S 9/12
2007/0006888 A1 * 1/2007 Hicks ..... B26D 3/161 131/70
2011/0011411 A1 * 1/2011 Accordino ..... A24C 5/42 131/70
2011/0056504 A1 3/2011 Laplante
2013/0276800 A1 10/2013 Lin et al.
2015/0298944 A1 * 10/2015 Leinonen ..... B66C 23/54 248/284.1

(Continued)

FOREIGN PATENT DOCUMENTS

BE 1017713 A3 * 4/2009 ..... A24C 5/42
DE 202019105604 U1 12/2019

OTHER PUBLICATIONS

Search Report from European Application No. 221807910.0 dated Dec. 8, 2022 (6 pages).

*Primary Examiner* — Philip Y Louie
*Assistant Examiner* — Sonny V Nguyen
(74) *Attorney, Agent, or Firm* — Calfee, Halter & Griswold LLP

(57) ABSTRACT

The present application relates to the field of cigarette making, and discloses a manual hydraulic cigarette manufacturing machine, which comprises a housing and a frame arranged in the housing. The frame is provided with a driving shaft, a pressing assembly, a discharge spoon, a transmission assembly, a swing arm, a push assembly, and a rebound assembly. In the present invention, linkage between the driving shaft and the swing arm is generated by hydraulic cylinder. Without the resistance force between gear transmissions, the transmission loss ratio is greatly reduced.

10 Claims, 6 Drawing Sheets

(56) References Cited

U.S. PATENT DOCUMENTS

| | | | | |
|---|---|---|---|---|
| 2019/0150499 | A1 | 5/2019 | Bao et al. | |
| 2019/0364955 | A1* | 12/2019 | Lin | A24C 5/40 |
| 2020/0281251 | A1 | 9/2020 | Liu | |

* cited by examiner

MANUAL HYDRAULIC CIGARETTE MANUFACTURING MACHINE

RELATED APPLICATION INFORMATION

The present application claims benefits and priority to Chinese Invention Patent Application No. 202110705646.X and Chinese Utility Model Patent Application No. 202121415561.X, which were filed on Jun. 24, 2021 with the State Intellectual Property Office in The People's Republic of China, the entire disclosures of which are fully incorporated herein by reference.

TECHNICAL FIELD

This application relates to the field of cigarette manufacturing, in particular to a manual hydraulic cigarette manufacturing machine.

BACKGROUND

Cigarette is a tobacco product manufactured by drying the tobacco, cutting into shreds, and then rolling into a barrel-shaped strip with a length of about 100 mm and a diameter of 8 mm. When consuming, one end of the cigarette is lit, and the smoke produced at the other end is inhaled. The manufacturing of cigarettes requires machines. First, mature tobacco leaves are steamed at a high temperature; then the tobacco leaves are put into a machine for sorting, cleaning, and cutting. Large pieces of tobacco leaves gradually become small pieces of compressed tobacco leaves, which are cut into shredded tobacco and finally packaged. The filter tip is packaged and cut into sections together with the shredded tobacco to produce the finished product of cigarette, which is finally packaged into a cigarette box.

The prior art manual cigarette making apparatus uses a single clutch for movement, which requires high precision for clutching. The arrangement of the conventional clutch requires that the rotating driving shaft and the central axis of the discharge spoon have one end at a high position and the other end at a low position. Even if there is only a slight inaccuracy in the clutch, the pressing of the material at the front end will be insufficient such that the material will not be compressed tightly enough. These conventional clutch systems have high manufacturing cost, are easily damaged during repeated use, and are difficult to repair. In addition, the linkage between the handle and the discharge spoon of the conventional arrangement is provided through gears, or gears and racks. When the handle is operated, the transmission loss ratio is large. If not lubricated adequately, the system may be susceptible to jams, when the operator needs to use more power to overcome the transmission loss, causing the problems of unsmooth operation and damage to the transmission parts. In addition, in the prior art cigarette making apparatus, when the discharge spoon pushes out the cigarette, the path of the cigarette tube is straight, while there is a small gap between the cigarette tube and the outlet. Therefore, in the process of the cigarette tube extending, reaching the maximum reach, and returning, there will always be tobacco shreds falling into and getting stuck in the gap between the cigarette discharge spoon and the outlet. The tobacco shreds in the gap are difficult to clean, and their long-term accumulation will push the discharge spoon to the outside, such that the discharge spoon cannot be pushed out smoothly and will have jams. Each time the material is discharged, the lateral pressure and friction must be overcome to extend the discharge spoon smoothly, such that the bearing connected with the discharge spoon or other connecting parts are also easily damaged. In addition, it is not sanitary when the tobacco shreds remain in the gaps for a long time, and microorganisms are prone to propagate in the gaps. The tobacco shreds themselves will also spoil, which negatively affects the hygiene of the cigarette manufacturing apparatus.

SUMMARY

The present application describes a manual hydraulic cigarette manufacturing machine having exemplary features addressing shortcomings in the prior art.

In an exemplary embodiment of the present application, a manual hydraulic cigarette manufacturing machine comprises a housing and a frame arranged in the housing. The frame is provided with a driving shaft, a pressing assembly, a discharge spoon, a transmission assembly, a swing arm, a push assembly, and a rebound assembly. The driving shaft is connected with a handle and rotates under the drive of the handle. The pressing assembly comprises a press plate being able to reciprocate along the y-axis direction, and the press plate is configured to press and mold tobacco shreds. The pressing assembly is in transmission connection with the driving shaft, which rotates and drives the movement of the press plate. The discharge spoon can be stretched out and retracted along the x-axis direction in the frame, and is configured to push out the molded tobacco shreds. The transmission assembly comprises a hydraulic cylinder, and a first piston rod and a second piston rod respectively positioned at the two ends of the hydraulic cylinder. The hydraulic cylinder comprises a first hydraulic chamber and a second hydraulic chamber connected to each other. The first piston rod reciprocates in the first hydraulic chamber, and the second piston rod reciprocates in the second hydraulic chamber. Under external force, one of the first and second piston rod drives the hydraulic oil in the corresponding hydraulic chamber to flow into the other hydraulic chamber, so as to drive the movement of the other piston rod. The upper end of the swing arm which is connected to the discharge spoon and drives the discharge spoon to move back and forth in the x-axis direction. The swing arm is in transmission connection with the second piston rod and swings under the drive of the second piston rod. The push assembly comprises a pushing member being able to push the first piston rod, and is coupled to the handle and swings under drive of the handle. The rebound assembly comprises a spring that interacts with the second piston rod, and the compression and rebound directions of the spring are consistent with the reciprocating direction of the second piston rod. By the configuration of the hydraulic cylinder, the first piston rod, and the second piston rod, the transmission direction can be changed. When the handle is pressed down, the contact surface with the first piston rod can almost be 90°. The surface of action between the second piston rod movement and the swing arm movement also remains perpendicular. According to the principle of force decomposition, the force loss during the handle transmission is very small, so as to ensure the smoothness of the process of compressing and discharging cigarette.

In an exemplary arrangement, the rebound assembly comprises a supporting block and a rod. The rod is fixed to the hydraulic cylinder or the frame. The supporting block is provided with a through-hole along the horizontal direction and a slot along the vertical direction. The supporting block is slidably arranged on the rod through the through-hole. The swing arm is provided with a fixing pillar, which is fitted in the slot and rotatable within the slot. One side of the supporting block is fixedly connected to the second piston rod, and the other side of the supporting block is in contact with a spring sleeved over the upper part of the rod.

In an exemplary arrangement, the push assembly further comprises pivotal plates and a drive block. The drive block is fixedly connected to the driving shaft. A first rotating shaft and a second rotating shaft are fixed between the pivotal plates on both sides. The drive block is installed on the first rotating shaft, and the pushing member is installed on the second rotating shaft. The pivotal plates have a downwardly curved bending section at least on the side of the pushing member. The drive block and the pushing member are respectively rotatable on the first rotating shaft and the second rotating shaft, and a first torsion spring is arranged between the first rotating shaft and the drive block.

In an exemplary arrangement, between the swing arm and the discharge spoon, a guide connector connected with the discharge spoon is provided, where the guide connector is slidably arranged on the frame and drives the discharge spoon to move along the x-axis direction, and a steering member and a second torsion spring are also provided. The steering member is respectively connected with the second torsion spring and the discharge spoon, and is installed on the guide connector. The swing arm has a first state where the second torsion spring has no elastic potential energy and a second state where the second torsion spring has elastic potential energy. When the swing arm is in the second state, the rotation of the second torsion spring drives the steering member to press the discharge spoon in the y-axis direction to change the orientation of the outlet of the discharge spoon inwardly or outwardly.

In an exemplary arrangement, a discharge port is fixed on the frame and is sleeved outside the discharge spoon. When the swing arm is in the first state, there is a gap between the discharge port and the discharge spoon. When the discharge spoon extends until the swing arm is in the second state, the discharge spoon leans inward, and there is no gap between the discharge port and the discharge spoon.

In an exemplary arrangement, a connecting piece is provided on the guide connector, and two connecting ends are arranged on the connecting piece. One of the two connecting ends is pin-connected to the swing arm, and the other end is pin-connected to the guide connector. One end of the second torsion spring is arranged between the connecting piece and the guide connector, or between the connecting piece and the swing arm, and can rotate in the horizontal direction. The other end of the second torsion spring extends outwards and is vertically bent to connect with the steering member. The angle between the connecting piece and the y-axis is $\alpha$, and the torsion state of the second torsion spring is related to $\alpha$.

In an exemplary arrangement, the pushing member is cylindrical, which is sleeved on the second rotating shaft and can rotate around the second rotating shaft. Operation of the handle comprises a first stage where the pushing member does not interact with the first piston rod and a second stage where the pushing member pushes the first piston rod to move. When the handle is moved in the second stage, the cylindrical surface of the pushing member and the pushing surface of the first piston rod are in contact with each other.

In an exemplary arrangement, the pressing assembly further comprises a connecting sleeve rod and a connecting plate. The connecting sleeve rod is sleeved on the driving shaft. One side of the connecting plate is pin-connected with the press plate, and the other side is pin-connected with the connecting sleeve rod. At least one driving arm is provided on the driving shaft. A third torsion spring is provided between the driving arm and the connecting sleeve rod. The distal end of the driving arm is provided with a protruding block, and the connecting plate is provided with an accommodation groove for accommodating the protruding block. When the handle is moved in the first stage, the protruding block is located in the accommodating groove and drives the connecting plate to move. When the handle is moved in the second stage, the protruding block is detached from the accommodating groove.

In an exemplary arrangement, the frame is provided with a through slot for accommodating the hydraulic cylinder. A part of the hydraulic cylinder corresponding to the first hydraulic chamber extends obliquely upwards from the front of the housing through the through slot, and a part of the hydraulic cylinder corresponding to the second hydraulic chamber extends horizontally on the back of the housing. The first piston rod and the second piston rod are respectively provided with a guide sleeve in between the hydraulic cylinder. Sealing rings are sleeved on the first piston rod and the second piston rod. A buffer pad is provided between the second piston rod and the hydraulic cylinder. A rotating bearing for installing a fixing pillar of the swing arm is arranged in the slot of the supporting part.

In an exemplary arrangement, the rebound assembly comprises a supporting block and a rod. The rod is fixed to the hydraulic cylinder or the frame. The supporting block is provided with a through-hole along the horizontal direction and a slot along the vertical direction. The supporting block is slidably arranged on the rod through the through-hole. The swing arm is provided with a fixing pillar which is fitted in the slot and rotatable within the slot. One side of the supporting block is fixedly connected to the second piston rod, and the other side of the supporting block is in contact with a spring sleeved over the upper part of the rod. The push assembly further comprises pivotal plates and a drive block which is fixedly connected to the driving shaft. A first rotating shaft and a second rotating shaft are fixed between the pivotal plates on both sides. The drive block is installed on the first rotating shaft, and the pushing member is installed on the second rotating shaft. The pivotal plates have a downwardly curved bending section at least on the side of the pushing member. The drive block and the pushing member are respectively rotatable on the first rotating shaft and the second rotating shaft. A first torsion spring is arranged between the first rotating shaft and the drive block. Between the swing arm and the discharge spoon, a guide connector connected with the discharge spoon is provided, where the guide connector is slidably arranged on the frame and drives the discharge spoon to move along the x-axis direction, and a steering member and a second torsion spring are also provided. The steering member is respectively connected with the second torsion spring and the discharge spoon, and is installed on the guide connector. The swing arm has a first state where the second torsion spring has no elastic potential energy and a second state where the second torsion spring has elastic potential energy. When the swing arm is in the second state, the rotation of the second torsion spring drives the steering member to press the discharge spoon in the y-axis direction to change the orientation of the outlet of the discharge spoon inwardly or outwardly.

According to an aspect of the present application, significant technical advantages may be provided. For example, there may be no need for a clutch device, which avoids the increased manufacturing and maintenance costs due to the clutch device. The hydraulic cylinder is used to generate linkage between the driving shaft and the swing arm. Without the resistance force between gear transmissions, the transmission loss ratio is thereby greatly reduced. The process becomes smoother where the handle is pressed downward to drive the swing arm, further driving the discharge spoon to stretch out. As the discharge spoon extends with good smoothness, the pressure on the handle is greatly reduced. The force is stored in the spring and the discharge spoon automatically bounces back after stretching out to output the molded cigarette tube, easily resetting the discharge spoon. At this time, the handle can be operated to reset it, where the states of the swing arm and the discharge spoon are not affected by the state of the handle.

When the discharge spoon outputs the cigarette, the torsion spring is configured to press the discharge spoon slightly inward, such that the orientation of the outlet of the discharge spoon is slightly twisted inward to contact the discharge port. Thus, even if a small amount of tobacco shreds falls on the wall of the discharge spoon or inside the spoon after the tobacco material is formed into a roll and pushed out, at the beginning of the recovery of the discharge spoon, there is no gap between the discharge spoon and the discharge port as the discharge port is tilted inward, and the tobacco shreds will not fall between the discharge spoon and the discharge port to cause blockage. As tobacco shreds will not accumulate in the gap, it is more sanitary, and there will be no blockage of the tobacco shreds to cause unsmooth reciprocation of the discharge spoon or even damage to the motor and parts. As result, the service life and operational safety of the device is improved.

Through the structural design, the overall precision of the apparatus is improved. Due to the fixed connection structure, an insufficient rotation angle of the driving shaft will not cause the tobacco shreds to be pressed not tightly enough when cigarettes are produced. The consistency of the stroke of the pressing member is ensured and the device has a very long service life.

The parts referred to by the numerical symbols in the attached drawings are as follows: 1, the housing; 2, the frame; 3, the driving shaft; 4, the pressing assembly; 5, the discharge spoon; 7, the push assembly; 9, the swing arm; 31, the handle; 41, the press plate; 42, the connecting sleeve rod; 43, the connecting plate; 44, the driving arm; 45, the third torsion spring; 51, the guide connector; 52, the steering member; 53, the second torsion spring; 54, the discharge port; 55, the connecting piece; 61, the hydraulic cylinder; 62, the first piston rod; 63, the second piston rod; 71, the pushing member; 72, the pivotal plate; 73, the drive block; 74, the first rotating shaft; 75, the second rotating shaft; 76, the first torsion spring; 81, the spring; 82, the supporting block; 83, the rod; 91, the fixing pillar.

DETAILED DESCRIPTION

The present application is described in further detail below in conjunction with the attached drawings and embodiments.

Figure 1:
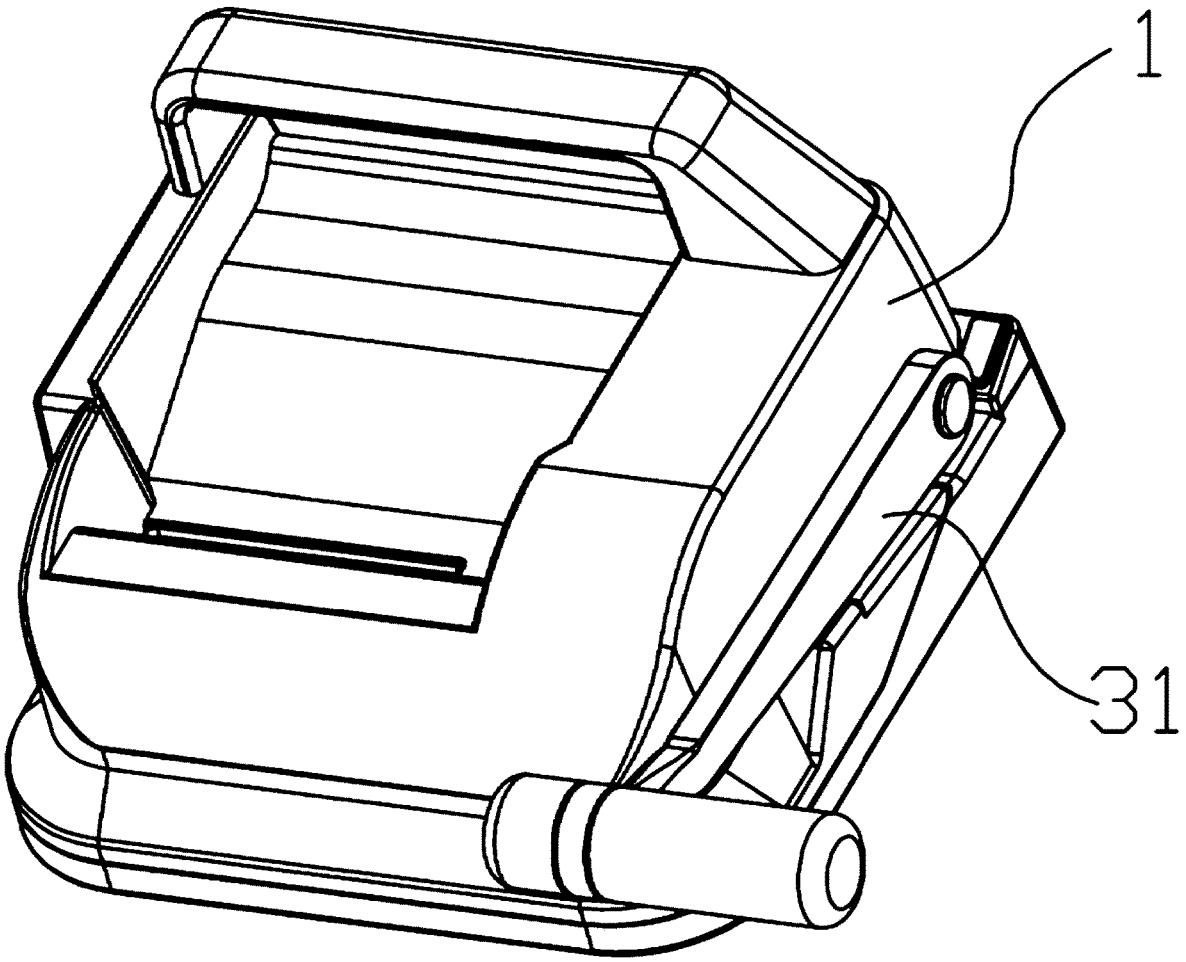
FIG. 1 is a schematic diagram of the structure of the present invention.
Figure 2:
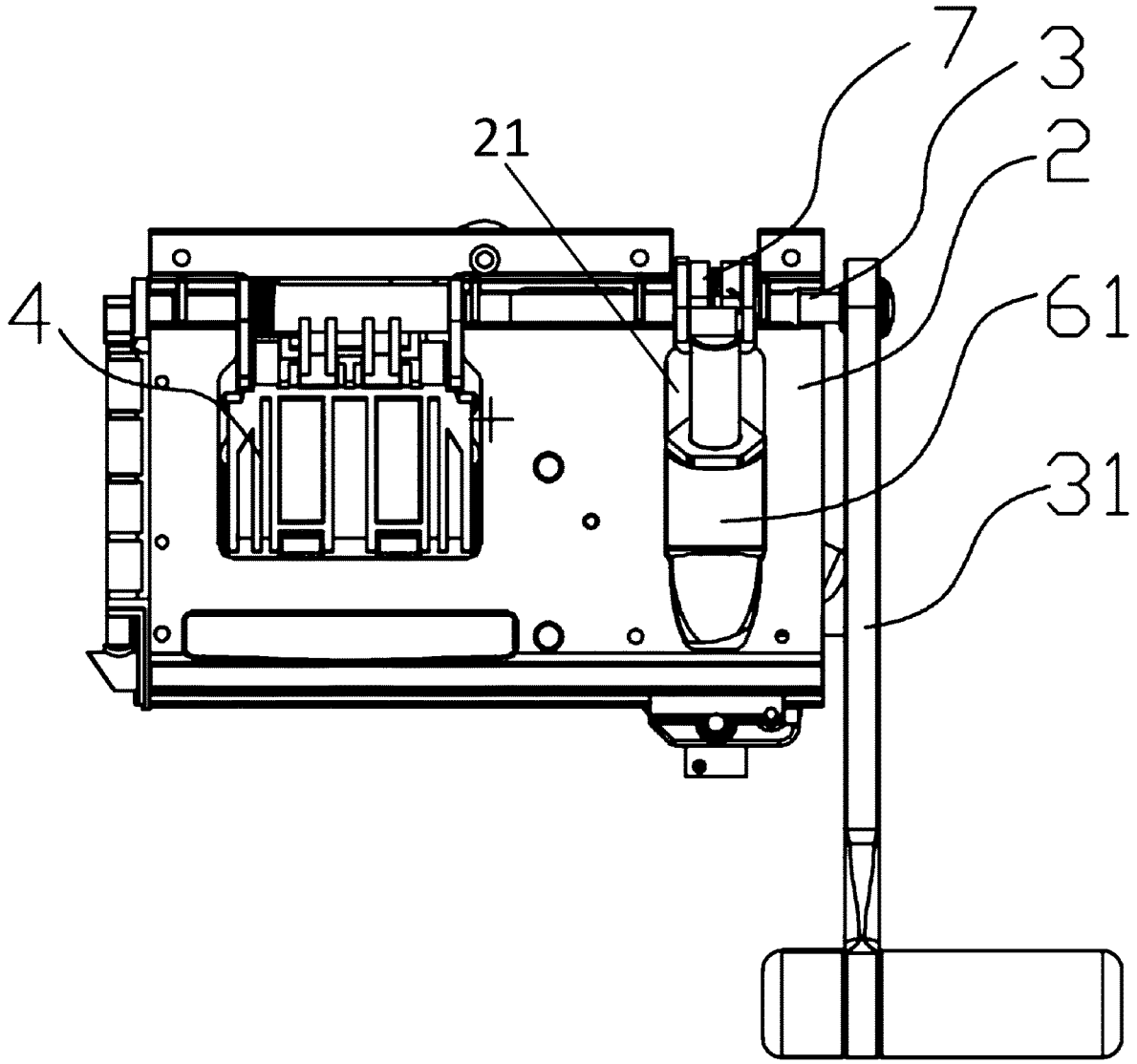
FIG. 2 is a schematic diagram of the front internal structure of the present invention.
Figure 3:
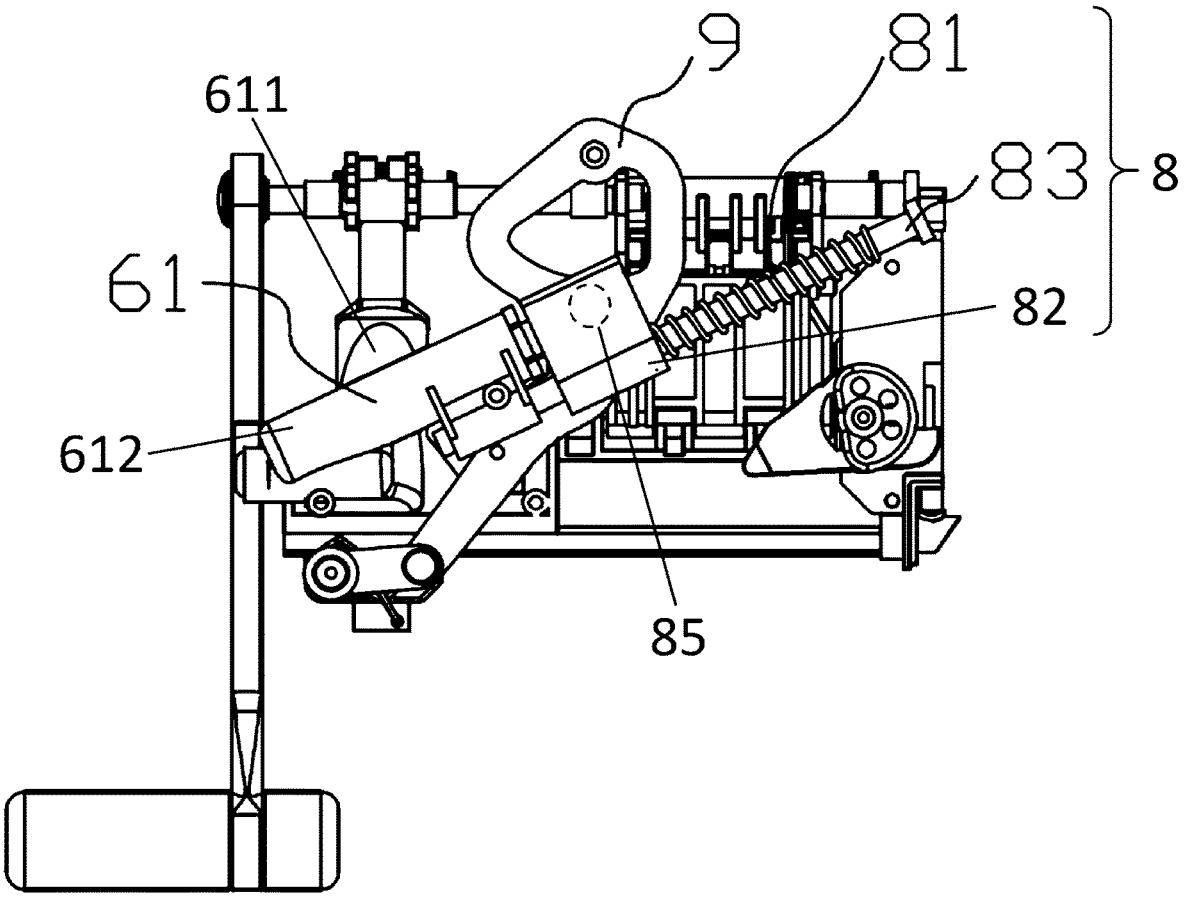
FIG. 3 is a schematic diagram of the internal structure of the rear side of the present invention with the frame removed.
Figure 4:
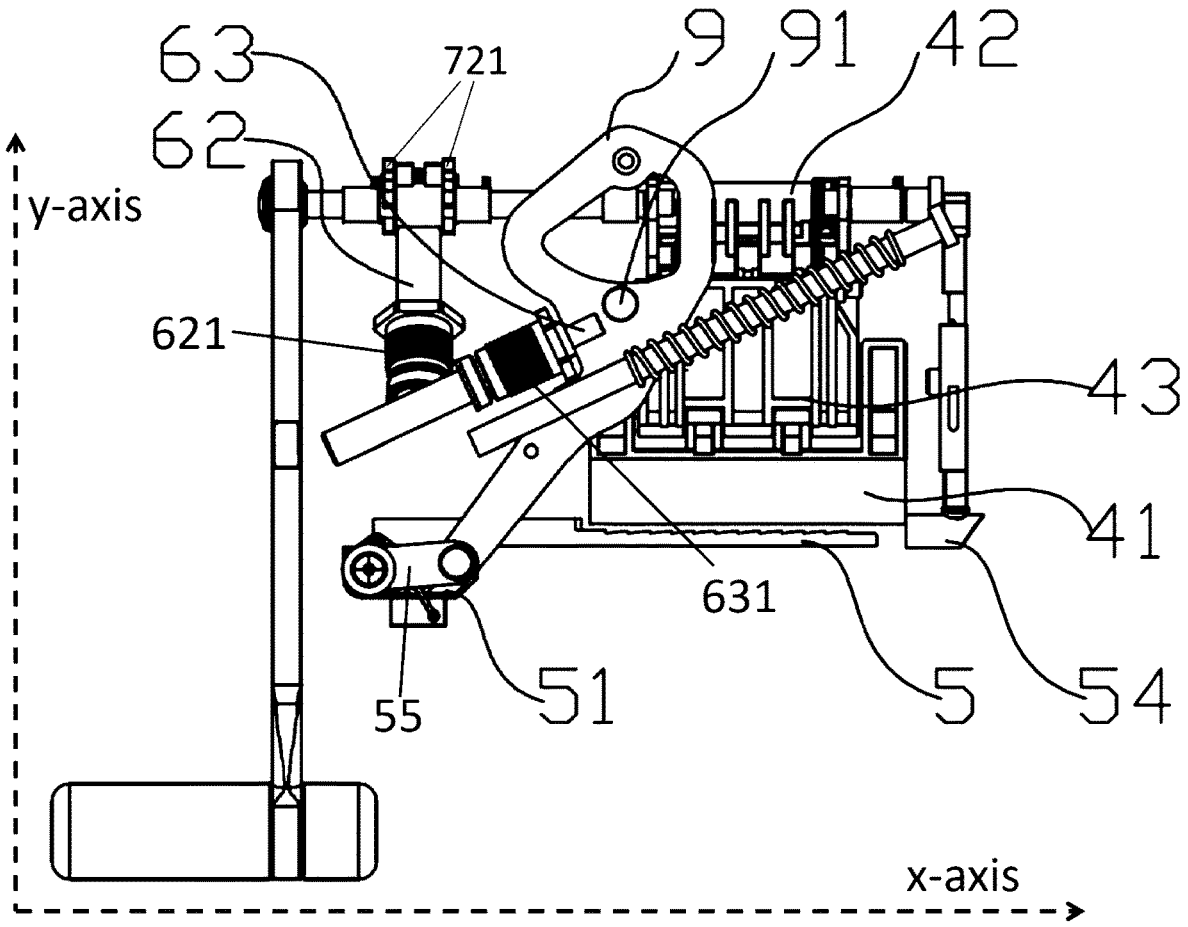
FIG. 4 is a schematic diagram of the internal structure of the rear side of the present invention with the frame, supporting block, and hydraulic cylinder removed.
Figure 5:
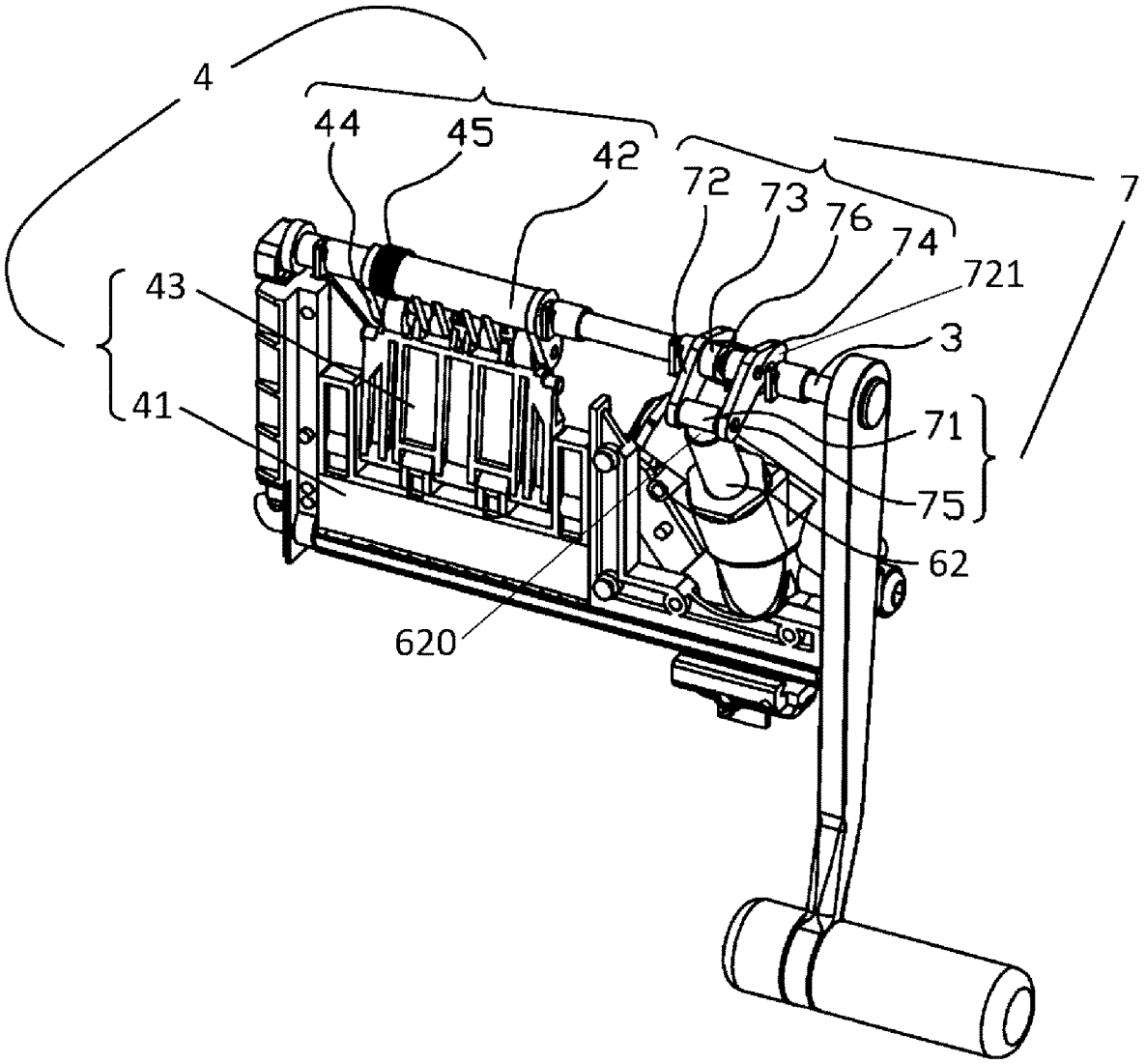
FIG. 5 is a schematic diagram of the internal structure of the present application.
Figure 6:
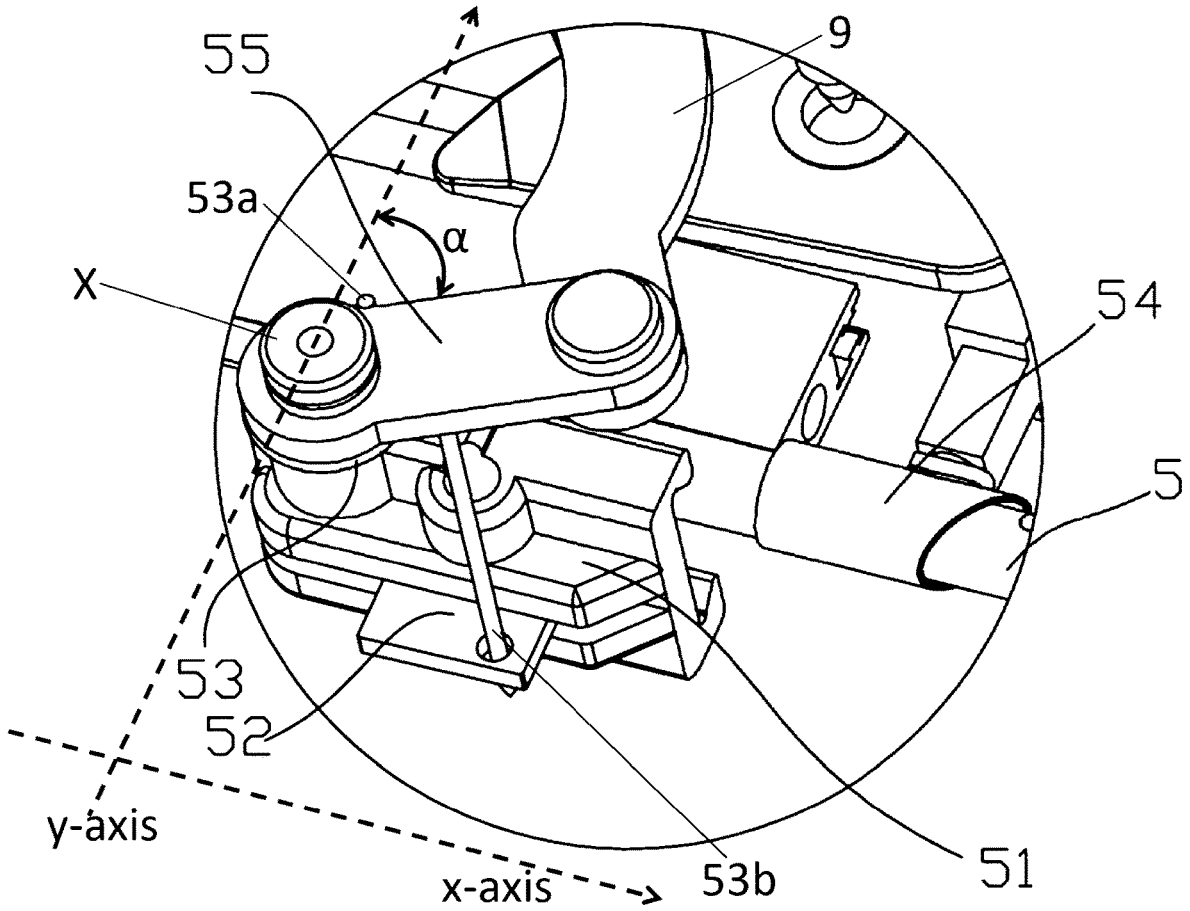
FIG. 6 is a schematic diagram of the connection structure of the guiding connector with the discharging spoon and the discharging port of the present application.

A manual hydraulic cigarette manufacturing machine, as shown in FIGS. 1-6, comprises a housing 1 and a frame 2 provided within the housing 1. A driving shaft 3, a pressing assembly 4, a discharge spoon 5, a transmission assembly, a swing arm 9, a push assembly 7, and a rebound assembly 8 are carried by the frame 2. The driving shaft 3 is connected with a handle 31 and is driven by the handle 31 to rotate. The pressing assembly 4 comprises a press plate 41 being able to reciprocate along the y-axis direction. The press plate 41 is configured to press and mold tobacco shreds. The pressing assembly 4 is in transmission connection with the driving shaft 3, and the driving shaft 3 rotates to drive the movement of the press plate 41. The discharge spoon 5 can stretch out and retract along the x-axis direction in the frame 2 for pushing out the molded tobacco shreds. The transmission assembly comprises a hydraulic cylinder 61, and a first piston rod 62 and a second piston rod 63 respectively arranged at both ends of the hydraulic cylinder 61. The hydraulic cylinder 61 comprises a first hydraulic chamber 611 and a second hydraulic chamber 612 connected to each other. The first piston rod 62 reciprocates in the first hydraulic chamber 611, and the second piston rod 63 reciprocates in the second hydraulic chamber 612. Under external force, one of the first and second piston rod drives the hydraulic oil in the corresponding hydraulic chamber to flow into the other hydraulic chamber, so as to drive the movement of the other piston rod. As shown in FIG. 4, the upper end of the swing arm 9 is connected with the discharge spoon 5 and drives the discharge spoon 5 to move back and forth along the x-axis direction. The swing arm 9 is in transmission connection with the second piston rod 63, and swings under the drive of the second piston rod 63. As shown in FIG. 5, the push assembly 7 comprises a pushing member 71 configured to push the first piston rod 62, and the push assembly 7 is connected with the handle 31 and swings under the drive of the handle 31. The rebound assembly 8 comprises a spring 81 interacting with the second piston rod 63, and the compression and rebound directions of the spring 81 are consistent with the reciprocating direction of the second piston rod 63.

As shown in FIG. 3, the rebound assembly 8 comprises a supporting block 82 and a rod 83. The rod 83 is fixed to the hydraulic cylinder 61 or the frame 2. The supporting block 82 is provided with a through-hole along the horizontal direction and a slot 85 along the vertical direction. The supporting block 82 is slidably arranged on the rod 83 through the through-hole. As shown in FIG. 4, the swing arm 9 is provided with a fixing pillar 91 which is fitted in the slot 85 and is rotatable within the slot 85. One side of the supporting block 82 is fixedly connected to the second piston rod 63, and the other side of the supporting block 82 is in contact with the spring 81 sleeved over the upper part of the rod 83. In another embodiment, the swing arm 9 is provided with a slot 85, the supporting block 82 is provided with a fixing pillar 91 matching the slot 85, and the rotating bearing as described below is installed in the slot 85 of the swing arm 9.

As shown in FIG. 5, the push assembly 7 further comprises pivotal plates 72 and a drive block 73. The drive block 73 is provided with two parallel shaft holes and a shaft hole sleeve. The drive block 73 is fixedly connected to the driving shaft 3. A first rotating shaft 74 and a second rotating shaft 75 are fixed between the pivotal plates 72 on both sides. The first rotating shaft 74 is inserted in the shaft hole of the drive block 73 parallel to the driving shaft. The pushing member 71 is installed on the second rotating shaft 75. The pivotal plates 72 have a downward bending section 721 with the first rotating shaft 74 at the center. The bending section 721 moves along the first piston rod 62 to a position beneath the first piston rod 62, and rotates along the first piston rod 62 in a direction where the bending section 721 folds together with the drive block 73. The pivotal plates 72 and the pushing member 71 are rotatable respectively on the first rotating shaft 74 and the second rotating shaft 75. A first torsion spring 76 is arranged between the first rotating shaft 74 and the drive block 73. The pivots at both ends of the first torsion spring 76 respectively press on the second rotating shaft 75 and the drive block 73.

Between the swing arm 9 and the discharge spoon 5, a connector 51 connected to the discharge spoon 5 is provided, where the guiding connector 51 is slidably arranged on the frame 2 and drives the discharge spoon 5 to move along the x-axis direction. A steering member 52 and a second torsion spring 53 are also provided between the swing arm 9 and the discharge spoon 5. The steering member 52 is connected to the second torsion spring 53 and the discharge spoon 5. The steering member 52 is installed on the guide connector 51. The swing arm 9 has a first state where the second torsion spring 53 has no elastic potential energy and a second state where the second torsion spring 53 has elastic potential energy. When the swing arm 9 is in the second state, the second torsion spring 53 rotates and drives the steering member 52 to press the discharge spoon 5 along the y-axis direction, such that the orientation of the outlet of the discharge spoon 5 is changed inwardly or outwardly.

A discharge port 54 is fixed on the frame 2. The discharge port 54 is sleeved outside the discharge spoon 5. When the swing arm 9 is in the first state, there is a gap between the outlet side of the discharge spoon 5 and the discharge port 54. When the discharge spoon 5 extends such that the swing arm 9 is at the second state, the outlet of the discharge spoon 5 leans toward the inward direction and there is no gap between the discharge port 54 and the discharge spoon 5.

A connecting piece 55 is provided on the guide connector 51, and two connecting ends are provided on the connecting piece 55. One of the two connecting ends is pin-connected to the swing arm 9 and the other end is pin-connected to the guide connector 51. One end 53*a* of the second torsion spring 53 is arranged between the connecting piece 55 and the guide connector 51, or between the connecting piece 55 and the swing arm 9, and is rotatable about a pin X connecting the connecting piece 55 to the connector 51. The other end 53*b* of the second torsion spring 53 extends outwards and is vertically bent to connect with the steering member 52. The angle between the connecting piece 55 and the y-axis is $\alpha$. The torsion state of second torsion spring 53 is related to $\alpha$.

The pushing member 71 is cylindrical. The pushing member 71 is sleeved over the second rotating shaft 75 and is rotatable around the second rotating shaft 75. The handle 31 may be at a first stage where the pushing member 71 does not interact with the first piston rod 62, or a second stage where the pushing member 71 pushes the second piston rod 62 to move. When the handle 31 is at the second stage, the cylindrical surface of the pushing member 71 and the pushing surface of the first piston rod 62 are in contact with each other.

The pressing assembly 4 further comprises a sleeve connecting rod 42 and a connecting plate 43. The connecting sleeve rod 42 is sleeved over the driving shaft. One side of the connecting plate 43 is pin-connected with the pressing plate 41, and the other side is pin-connected with the connecting sleeve rod 42. At least one driving arm 44 is provided on the driving shaft, and a third torsion spring 45 is provided between the driving arm 44 and the connecting sleeve rod 42. The distal end of the driving arm 44 is provided with a protruding block, and the connecting plate 43 is provided with an accommodation groove for accommodating the protruding block. When the handle 31 is at the first stage, the protruding block is located in the accommodating groove and drives the connecting plate 43 to move. When the handle 31 is at the second stage, the protruding block is detached from the accommodating groove.

The frame 2 is provided with a through slot 21 for accommodating a hydraulic cylinder 61. A part of the hydraulic cylinder 61 corresponding to the first hydraulic chamber 611 obliquely extends upwards from the front of the housing 1 through the through slot 21, and a part of the hydraulic cylinder 61 corresponding to the second hydraulic chamber 612 part extends horizontally on the back of the housing 1.

The first piston rod 62 and the second piston rod 63 are respectively provided with guide sleeves 621 and 631 in between the hydraulic cylinder 61. Sealing rings are sleeved over the first piston rod 62 and the second piston rod 63. A buffer pad is provided between the second piston rod 63 and the hydraulic cylinder 61. A rotating bearing for installing a fixing pillar 91 of the swing arm 9 is arranged in the slot 85 of the supporting part 82.

In operation, the tobacco shreds are deposited from the opening above the frame 2. The handle 31 is operated from the initial position to drive the driving shaft 3 to rotate. The rotation direction of the driving shaft 3 can be clockwise or counterclockwise. Here, only to make a distinction in the direction, counterclockwise rotation is taken as an example.

At this time, the handle 31 is at the first stage. The handle 31 drives the driving shaft 3 to rotate. The drive block 73 connected with the driving shaft 3 and the driving arm 44 both rotate with the driving shaft. Due to the first torsion spring 76 arranged between the driving member and the first rotating shaft 74, the pivotal plates 72 connected with the first rotating shaft 74 move along with the driving member, and the pushing member 71 installed at the front end of the pivotal plates 72 also moves in an arc shape toward the first piston rod 62. Due to the third torsion spring 45 provided between the driving arm 44 and the connecting sleeve rod 42, the protruding block at the front end of the driving arm 44 is accommodated in the accommodating groove. The driving shaft 3 rotates to drive the driving arm 44. The driving arm 44 pushes down with the front end of the connecting sleeve rod 42, driving the rear end of the connecting plate 43 to move from a high position to a low position. The front end of the connecting plate 43 naturally moves forward along the y-axis direction, and the press plate in pin-connection with the front end of the connecting plate 43 naturally pushes forward to squeeze the tobacco shreds deposited in the opening into the discharge spoon 5.

At this time, the handle 31 transitions from the first stage into the second stage. At beginning, the swing arm 9 is still at the first state. The handle 31 continues to rotate to drive the driving shaft 3 to rotate counterclockwise, and the handle 31 continues to advance obliquely downward in an arc after the pushing member 71 contacts the first piston rod 62. Being pushed by the pushing member 71, the first piston rod 62 presses into the first hydraulic chamber 611 of the hydraulic cylinder 61. The hydraulic oil in the first hydraulic chamber 611 flows into the second hydraulic chamber 612 under the action of the first piston rod 62. The hydraulic oil in the second hydraulic chamber 612 drives the second piston rod 63 to stretch outward, moving forward together with the supporting block 82 fixedly connected with the second piston rod 63. Since the supporting block 82 and the swing arm 9 are in connection and limit the movement of each other, the swing arm 9 is driven by the supporting block 82 to swing in the direction in which the second piston rod 63 extends. The swing arm 9 swings to drive and push out the discharge spoon 5 connected to it. At the same time, as the second piston rod 63 pushes the supporting block 82 to move, the spring 81 on the rod 83 gradually compresses and stores elastic potential energy. The protruding block at the front end of the driving arm 44 separates from the accommodating groove and continues to move, while the connecting sleeve rod 42 and the connecting plate 43 still remain at a transitioning position between the first stage and the second stage, and the press plate 41 remains in pressed state.

During the second stage of movement of the handle 31, the swing arm 9 moves between a first state where the second torsion spring 53 has no elastic potential energy and a second state where the second torsion spring 53 has elastic potential energy. Here, the second torsion spring 53 requires a horizontal force to generate elastic potential energy. The horizontal force may act between the second torsion spring 53 and the swing arm 9, or between the second torsion spring 53 and the connecting piece 55. In this embodiment, the connecting piece 55 is responsible for generating the horizontal force for the torsion of the second torsion spring 53. Let angle $\alpha$ be a fixed value $\beta$, when the swing arm 9 is at the critical point between the first state and the second state. In the process of adding and pressing tobacco, and when the discharge spoon 5 extends by a certain distance but $\alpha$ has not reached $\beta$ yet, the swing arm 9 is at the first state. At this time the value of $\alpha$ is very small, and the connection piece 55 does not have interaction with the second torsion spring 53. After pressing is completed and in the process of pushing out the discharge spoon 5, the angle between the connecting piece 55 and the y-axis is $\alpha$. At this time, the guide connector is close to the other end but has not reached it, and a gradually increases. When a reaches the fixed value $\beta$, the swing arm 9 is at the second state. The connecting piece 55 touches the acting end of the second torsion spring 53. The acting end of the second torsion spring 53 is in contact with the connecting piece 55 and starts to generate a force. The second torsion spring 53 rotates to drive the steering member 52 to press the discharge spoon 5 along the y-axis direction, such that the orientation of the outlet of the discharge spoon 5 changes inwardly. This change is slight. At this time, the discharge spoon 5 is fitted with the discharge port 54 and the gap between them is closed. After the discharging is completed, the discharge spoon 5 must be operated to retract. At this time, $\alpha$ is still greater than $\beta$, and the inner wall of the discharge spoon 5 is still fitted with the discharge port 54. Because the diameter of the molded tobacco shreds is larger than that of the discharge spoon 5 and the outlet is provided on the inside, when the discharge spoon 5 is retracted after the tobacco is pushed out of the discharge port, the tobacco will be blocked by the edge of the discharge port such that the tobacco will not be brought back into the compression chamber. When the discharge spoon 5 retracts such that $\alpha$ is less than $\beta$, the discharge spoon 5 automatically returns to the state where the discharge spoon 5 is in line with the x-axis, because the steering member 52 exerts no pushing force on the discharge spoon 5. Repeatedly, while the discharge spoon 5 is outstretched, or is starting to retract, the discharge spoon 5 leans toward the inside and contacts the discharge port 54, such that there is no longer a gap between the two.

When the discharge spoon 5 stretches to the limit, the pushing member 71 separates from the pushing surface 620 of the first piston rod 62 and moves to a position beneath the first piston rod 62 due to its arc-shaped movement. Since the first piston rod 62 is no longer subject to the pushing force, and due to the linkage with the spring 81 of the rebound assembly 8, the spring 81 storing the elastic potential energy pushes the receiving block 82 along the rod 83. The supporting block 82 drives the swing arm 9 to swing back, and the swing arm 9 drives the discharge spoon 5 back to the initial position. The supporting block 82 pushes the second piston rod 63 into the second hydraulic chamber 612 at the same time. The hydraulic oil is pushed from the second hydraulic chamber 612 into the first hydraulic chamber 611 to outwardly reset the first piston rod 62. Since the first torsion spring 76 is arranged between the first rotating shaft 74 and the drive block 73, the turning handle 31 rotates clockwise to drive the drive block 73 to move back. The pushing member 71 between the pivotal plates 72 returns to the initial position along the lower surface of the first piston rod 62. When the pushing member 71 returns along the bottom of the first piston rod 62, the first torsion spring 76 between the pivotal plates 72 and the pushing member 71 rotates and stores elastic potential energy. When the pushing member 71 is separated from the first piston rod 62, under the action of the torsion spring, the original angle between the pivotal plates 72 and the pushing member 71 is restored.

In all, the above descriptions are only preferred embodiments of the present invention, and any changes and modifications made in accordance with the scope of the present disclosure shall be covered by the present patent application.

The invention claimed is:

1. A manual hydraulic cigarette manufacturing machine comprising a housing and a frame arranged in the housing, the frame being provided with:

a driving shaft connected with a handle and rotatable by operation of the handle;

a pressing assembly comprising a press plate that moves reciprocally in a y-axis direction, wherein the press plate is configured to press and mold tobacco shreds, the pressing assembly is in transmission connection with the driving shaft, and the driving shaft rotates to drive the press plate to move;

a discharge spoon configured to stretch out and retract along an x-axis direction in the frame to push out tobacco shreds that have been molded by the press plate;

a transmission assembly comprising a hydraulic cylinder and a first piston rod and a second piston rod respectively provided at two ends of the hydraulic cylinder, wherein the hydraulic cylinder comprises a first hydraulic chamber and a second hydraulic chamber connected to each other, the first piston rod reciprocates in the first hydraulic chamber, and the second piston rod reciprocates in the second hydraulic chamber, wherein under external force, one of the first piston rod and the second piston rod drives a hydraulic oil in a corresponding one of the first hydraulic chamber and the second hydraulic chamber to flow into the other of the first hydraulic chamber and the second hydraulic chamber, so as to drive the movement of the other of the first piston rod and the second piston rod;

a swing arm comprising an upper end connected to the discharge spoon and drives the discharge spoon to reciprocate in the x-axis direction, wherein the swing arm is in transmission connection with the second piston rod and swings under drive of the second piston rod;

a push assembly comprising a pushing member configured to push the first piston rod, wherein the push assembly is coupled to the handle and swings under drive of the handle, wherein the pushing member is a cylindrical member sleeved over a rotating shaft;

a rebound assembly comprising a spring interacting with the second piston rod through movement in compression and rebound directions, wherein the compression and rebound directions of the spring are substantially parallel with a reciprocating direction of the second piston rod.

2. The manual hydraulic cigarette manufacturing machine according to claim 1, wherein the rebound assembly comprises a supporting block and a rod, the rod is fixed to the hydraulic cylinder or the frame, the supporting block is provided with a through-hole along a horizontal direction and a slot along a vertical direction, the supporting block is slidably arranged on the rod through the through-hole, the swing arm is provided with a fixing pillar, the fixing pillar is fitted in the slot and is rotatable within the slot, one side of the supporting block is fixedly connected to the second piston rod, and another side of the supporting block is connected to a second spring sleeved over an upper part of the rod.

3. The manual hydraulic cigarette manufacturing machine according to claim 1, wherein the push assembly further comprises pivotal plates and a drive block, the drive block is fixedly connected to the driving shaft, a first rotating shaft and a second rotating shaft are fixed between the pivotal plates on both sides, the drive block is installed on the first rotating shaft, the pushing member is sleeved over the second rotating shaft, the pivotal plates have a downwardly curved bending section at least on a side of the pushing member, the drive block and the pushing member are respectively rotatable on the first rotating shaft and the second rotating shaft, and a first torsion spring is arranged between the first rotating shaft and the drive block.

4. The manual hydraulic cigarette manufacturing machine according to claim 3, wherein, between the swing arm and the discharge spoon, a guide connector connected with the discharge spoon is provided, where the guide connector is slidably arranged on the frame and drives the discharge spoon to move along the x-axis direction, and a steering member and a second torsion spring are provided, wherein the steering member is connected with the second torsion spring and the discharge spoon, and is installed on the guide connector, wherein the swing arm has a first state where the second torsion spring has no elastic potential energy and a second state where the second torsion spring has elastic potential energy, wherein, when the swing arm is at the second state, the elastic potential energy rotates the second torsion spring to drive the steering member to press the discharge spoon in the y-axis direction to change a direction of an outlet of the discharge spoon inwardly or outwardly.

5. The manual hydraulic cigarette manufacturing machine according to claim 4, wherein a discharge port is fixed on the frame and is sleeved outside the discharge spoon, wherein, when the swing arm is at the first state, there is a gap between the discharge port and an opening side of the discharge spoon, wherein, when the discharge spoon extends such that the swing arm is at the second state, the discharge spoon leans inward, and there is no gap between the discharge port and the discharge spoon.

6. A discharge spoon return mechanism of the cigarette manufacturing machine according to claim 5, wherein a connecting piece is provided on the guide connector, wherein two connecting ends are arranged on the connecting piece, one of the two connecting ends is pin-connected to the swing arm, and the other of the two connecting ends is pin-connected to the guide connector, wherein one end of the second torsion spring is arranged between the connecting piece and the guide connector, or between the connecting piece and the swing arm, and is rotatable in a horizontal direction, the other end of the second torsion spring extends outward and is vertically bent to connect with the steering member, and a torsion state of the second torsion spring is related to an angle between the connection piece and the y-axis direction.

7. The manual hydraulic cigarette manufacturing machine according to claim 4, wherein operation of the handle includes a first stage where the pushing member does not interact with the first piston rod and a second stage where the pushing member pushes the first piston rod to move, wherein, when the handle is at the second stage, a cylindrical surface of the pushing member and a pushing surface of the first piston rod are in contact with each other.

8. The manual hydraulic cigarette manufacturing machine according to claim 7, wherein the pressing assembly further comprises a connecting sleeve rod and a connecting plate, the connecting sleeve rod is sleeved over the driving shaft, one side of the connecting plate is pin-connected with the press plate, and the other side of the connecting plate is pin-connected with the connecting sleeve rod, wherein at least one driving arm is provided on the driving shaft, a third torsion spring is provided between the at least one driving arm and the connecting sleeve rod, a distal end of the at least one driving arm is provided with a protruding block, and the connecting plate is provided with an accommodation groove for accommodating the protruding block, wherein, when the handle is at the first stage, the protruding block is located in the accommodating groove and drives the connecting plate to move, and when the handle is at the second stage, the protruding block is detached from the accommodating groove.

9. The manual hydraulic cigarette manufacturing machine according to claim 7, wherein the frame is provided with a through slot for accommodating the hydraulic cylinder, and a part of the hydraulic cylinder corresponding to the first hydraulic chamber extends obliquely upwards from a front of the housing through the through slot, and a part of the hydraulic cylinder corresponding to the second hydraulic chamber part extends horizontally on a back portion of the housing, wherein the first piston rod and the second piston rod are respectively provided with a guide sleeve between the hydraulic cylinder, sealing rings are sleeved on the first piston rod and the second piston rod, a buffer pad is provided between the second piston rod and the hydraulic cylinder, and a rotating bearing for installing a fixing pillar of the swing arm is arranged in a slot of a supporting part.

10. The manual hydraulic cigarette manufacturing machine according to claim 1, wherein the rebound assembly comprises a supporting block and a rod, the rod is fixed to the hydraulic cylinder or the frame, the supporting block is provided with a through-hole along a horizontal direction and a slot along a vertical direction, the supporting block is slidably arranged on the rod through the through-hole, the swing arm is provided with a fixing pillar which is fitted in the slot and is rotatable in the slot, one side of the supporting block is fixedly connected to the second piston rod, and the other side of the supporting block is in contact with a second spring sleeved over an upper part of the rod, wherein the push assembly further comprises pivotal plates and a drive block, the drive block is fixedly connected to the driving shaft, a first rotating shaft and a second rotating shaft are fixed between the pivotal plates on both sides, the drive block is installed on the first rotating shaft, the pushing member is installed on the second rotating shaft, the pivotal plates have a downwardly curved bending section at least on a side of the pushing member, the drive block and the pushing member are respectively rotatable on the first rotating shaft and the second rotating shaft, and a first torsion spring is arranged between the first rotating shaft and the drive block, wherein, between the swing arm and the discharge spoon, a guide connector connected with the discharge spoon is provided, the guide connector is slidably arranged on the frame and drives the discharge spoon to move along the x-axis direction, and a steering member and a second torsion spring are also provided, wherein the steering member is connected with the second torsion spring and the discharge spoon, the steering member is installed on the guide connector, the swing arm has a first state where the second torsion spring has no elastic potential energy and a second state where the second torsion spring has elastic potential energy, wherein, when the swing arm is at the second state, the elastic potential energy rotates the second torsion spring to drive the steering member to press the discharge spoon in the y-axis direction to change a direction of the outlet of the discharge spoon inwardly or outwardly.

* * * * *